US006161737A

United States Patent [19]

Leary

[11] Patent Number: 6,161,737

[45] Date of Patent: Dec. 19, 2000

[54] BOTTLE WITH ROTATIONAL DISPENSER

[76] Inventor: Cornelius F. Leary, 1176 Waycross Rd. Apt. B308, Cincinnati, Ohio 45240

[21] Appl. No.: 09/241,593

[22] Filed: Feb. 2, 1999

Related U.S. Application Data

[63] Continuation-in-part of application No. 08/713,819, Sep. 13, 1996, Pat. No. 5,865,352.

[60] Provisional application No. 60/003,812, Sep. 15, 1995.

[51] Int. Cl.[7] ..... B67D 5/06

[52] U.S. Cl. ..... 222/517; 222/534; 222/536

[58] Field of Search ..... 222/534, 536, 222/530, 517, 528, 529; 220/253, 334, 338; 215/235

[56] References Cited

U.S. PATENT DOCUMENTS

| | | | |
|---|---|---|---|
| 2,893,612 | 7/1959 | Akers | 222/536 |
| 3,140,020 | 7/1964 | Spier | 222/517 |
| 4,732,303 | 3/1988 | Wang | 222/517 |
| 5,114,051 | 5/1992 | Simon | 222/517 |
| 5,370,284 | 12/1994 | Dirksing | 222/534 |
| 5,865,352 | 2/1999 | Leary | 222/517 |

*Primary Examiner*—Philippe Derakshani

*Attorney, Agent, or Firm*—James J. Leary; Carol D. Titus

[57] ABSTRACT

A container for storing and dispensing viscous liquids which dispenses from the bottom of the container and which has a self-closing, non-drip dispensing spout. The dispensing spout may be provided on the bottom of an upright container having a cap at the other extremity or as a part of a removable cap for the container having a flat upper surface for storing the container in an inverted position. A self-operating closure allows one-handed operation of the container. The self-operating closure has a pivotable dispensing tube and valve with an open position and a closed position which is operated by the pivoting action of the dispensing tube. The pivotable dispensing tube and the valve are biased into a closed position to make the closure self-operating. A detent may be provided for holding the pivotable dispensing tube in an open position against the bias. The closure is operated by urging the pivotable dispensing tube past the detent, either manually or by setting the dispensing bottle down on a horizontal surface, whereupon the dispensing tube and therefore the valve are urged to a closed position. The fluid passage through the pivotable dispensing spout is configured so that, when the dispensing spout is in the closed position, any fluid within the passage will tend to flow back toward the closed valve instead of dripping from the end of the dispensing tube.

19 Claims, 15 Drawing Sheets

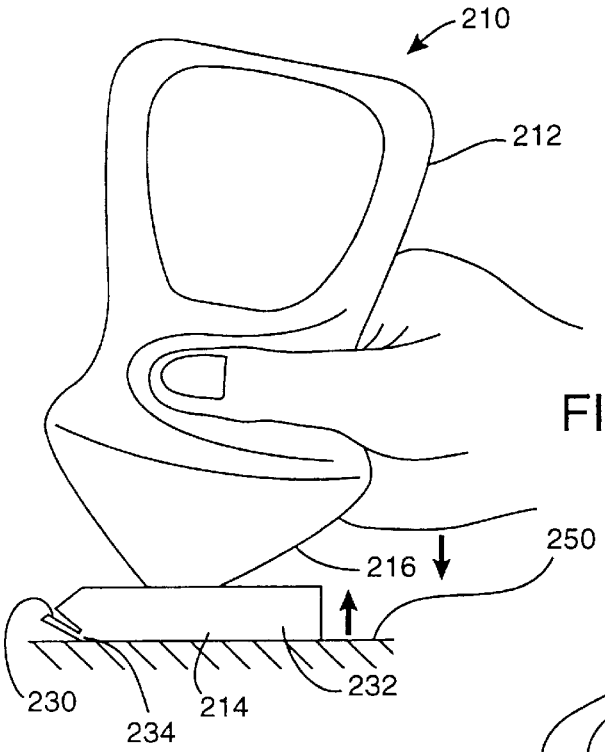
FIG. 9A
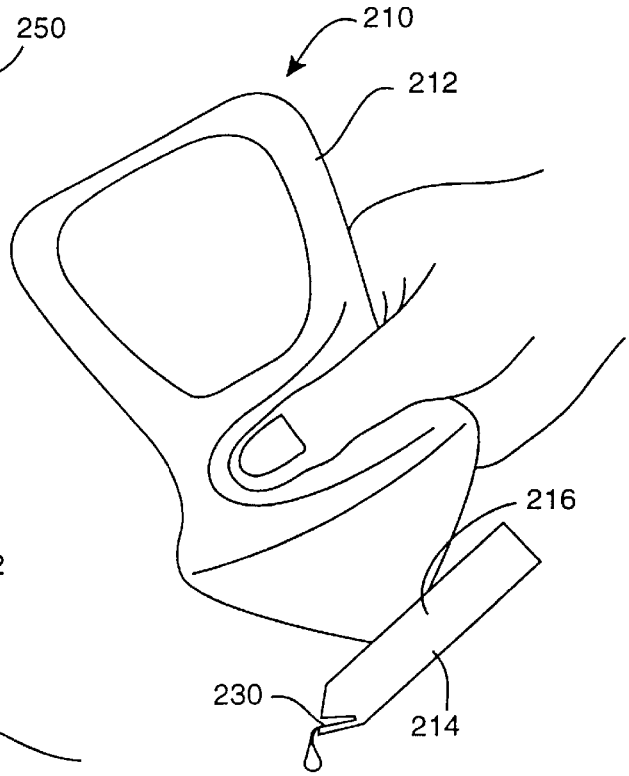
FIG. 9B
FIG. 9C
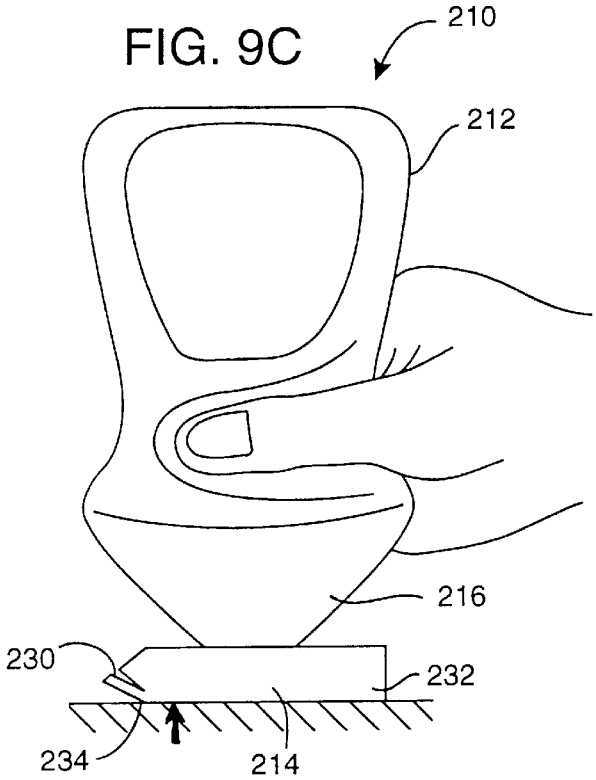

BOTTLE WITH ROTATIONAL DISPENSER

CROSS REFERENCE TO OTHER APPLICATIONS

This application is a continuation-in-part of U.S. patent application Ser. No. 08/713,819 filed Sep. 13, 1996, now U.S. Pat. No. 5,865,352, issued Feb. 2, 1999, which claims priority of U.S. Provisional Application No. 60/003,812 filed Sep. 15, 1995.

FIELD OF THE INVENTION

The present invention relates generally to containers and dispensers. More particularly, the invention relates to a container for storing and dispensing viscous liquids which dispenses from the bottom of the container and which has a self-closing, non-drip dispensing spout.

BACKGROUND OF THE INVENTION

Viscous liquids, such as liquid soap, hand lotion, sun screen, shampoo, hair conditioner, or food condiments like mustard, catchup, mayonnaise, etc., pose particular difficulties in dispensing. The viscosity of these liquids makes it difficult to dispense them from standard, top-opening containers because the liquid tends stay in the bottom of the container even when the container is inverted. It often takes considerable patience on the part of the user to wait until the viscous liquid reaches the opening or the dispensing spout on the top of the container after the container is inverted. If the container is only partially full or if the liquid is particularly viscous, the weight of the liquid by itself is sometimes not enough to create sufficient shear force to overcome the viscosity and to initiate flow. The user must frequently resort to shaking or banging the container to coax the liquid out. It would be much more convenient for the user if the liquid were always close to the opening or dispensing tube of the container so that it is immediately ready to be dispensed.

One attempted solution to this problem that has been available for years is the use of pump-type dispensers on containers for viscous liquids. The dispenser pump typically has a scavenging tube which reaches down to the bottom of the container. Once the pump is primed with the liquid, it generally stays primed so that the liquid can immediately be dispensed by pressing on the pump without waiting for the liquid to rise from the bottom of the container. This, however, is an incomplete solution to the problem. Pump-type dispensers are rarely effective at dispensing all of the liquid which is inside the container, especially when the liquid is viscous. Some liquid nearly always remains in the bottom of the container beyond the reach of the scavenging tube. This is wasteful and it is frequently frustrating to the user who struggles to get the last bit of product out of the container. Particularly with viscous liquids, the dispenser pumps are also prone to dripping between uses which causes some small mess on the counter or shelf or on the outside of the container. Another problem with this solution is that the long, thin tubes that lead to and from the pump mechanism have a tendency to clog when the liquid dries or thickens in the tubes between uses. The complexity of dispensing pumps also makes them prone to breakage or mechanical failure and also adds to the expense of the container. Pump dispensers of this type are convenient for stationary, countertop use, but they pose special problems when traveling because the pump mechanism can be inadvertently activated inside of the user's luggage or purse when something presses against the pump when closing the luggage or when things move around inside the luggage during travel or baggage handling. Adding a locking mechanism or overcap to the pump dispenser for storage or travel solves this problem, but it increases the complexity and cost of the container.

Another solution to the problems associated with dispensing viscous liquids which has gained recent popularity in the packaging industry is the use of self-standing tube containers. Typically, a self-standing tube container consists of a flexible plastic squeeze tube or bottle with a screw-on cap that is adapted to act as a base to stand the tube on its end. The cap may be a simple screw-on lid or it may have a flip-top or a dispensing tube or spout incorporated into the cap. The cap is made with a wide, flat end surface that provides a stable base for standing the tube or bottle up on its end. Because the closed end of a squeeze tube is pointed, the cap is generally the only surface of the container suitable for standing the tube on a shelf, insuring that the container will always be stored in the correct inverted position. Likewise, when the container is a flexible plastic bottle, the end of the bottle opposite the cap is sometimes made with a rounded end so that the cap is the only surface suitable to stand the bottle on a shelf. Because the container rests on the shelf in an inverted position with the cap down, the liquid inside always settles near the opening or dispensing tube of the container for immediate dispensing. However, this too is an incomplete solution to the problem. Simple screw-on caps are inconvenient in this application, because it often requires three hands to operate them. If a user has picked up a container of, say, hand lotion with one hand and taken the cap off with the other hand, the user must put the cap down in order to dispense the hand lotion onto the free hand. Now the user has the container in one hand and a dollop of hand lotion in the other. He or she does not have a free hand left to pick the cap up and put it back on the container. However, he or she cannot set the tube down to finish applying the hand lotion because the only standing surface on the container is on the cap which is currently lying by itself on the countertop. This frustrating situation usually results in odd contortions or careful juggling acts to apply the lotion or to finagle the cap back onto the container without a free hand. Flip-top caps or caps with built-in dispensing tubes simplify this problem because the cap remains attached to the container during dispensing, but it is still difficult to close the container without a free hand so that it can be set down while applying the dispensed lotion. It would be desirable therefore to provide a container which does not require a spare hand and can close itself after the user is through with dispensing.

SUMMARY OF THE INVENTION

In keeping with the foregoing discussion, an objective of the present invention is to provide a bottom-dispensing container where the liquid to be dispensed is always near the dispensing spout of the container when it is stored. This allows immediate dispensing of the liquid without having to wait for the liquid to reach the dispensing spout. In one aspect of the invention, the dispensing spout may be provided on the bottom of an upright container having a cap at the other extremity. In another aspect of the invention, the dispensing tube may be provided in a removable cap for the container having a flat upper surface for storing the container in an inverted position.

Another objective of the present invention is to provide the dispensing container with a self-operating closure which allows one-handed operation of the container so that another hand is not needed for operating the closure. In one aspect of the invention, the self-operating closure is provided with a pivotable dispensing tube having a fluid passage therethrough which communicates with the interior of the container, preferably near the bottom of the container. The pivotable dispensing tube has a valve with an open position and a closed position which is operated by the pivoting action of the dispensing tube. A biasing means urges the pivotable dispensing tube and the valve into a closed position to make the closure self-operating.

In another aspect of the invention, a detent may be provided for holding the pivotable dispensing tube in an open position against the urging of the biasing means. The closure is operated by urging the pivotable dispensing tube past the detent, either manually or by setting the dispensing bottle down on a horizontal surface, whereupon the biasing means operates to move the dispensing tube and therefore the valve to a closed position. In a preferred embodiment, the pivotable dispensing tube and the dispensing container are configured so that the act of setting the container down on a horizontal surface, such as a shelf or countertop, provides the force to urge the pivotable dispensing tube past the detent to initiate the self-closing action. In yet another aspect of the invention, the self-operating closure has incorporated therein a non-drip feature. The non-drip feature is provided by configuring the fluid passage within the pivotable dispensing spout so that, when the dispensing spout is in the closed position, any fluid within the passage will tend to flow back toward the closed valve instead of out the end of the dispensing tube.

BRIEF DESCRIPTION OF THE DRAWINGS

FIGS. 9A, 9B and 9C illustrate the operation of the dispensing bottle of FIGS. 7A and 7B.

DETAILED DESCRIPTION OF THE INVENTION

Figure 1B:
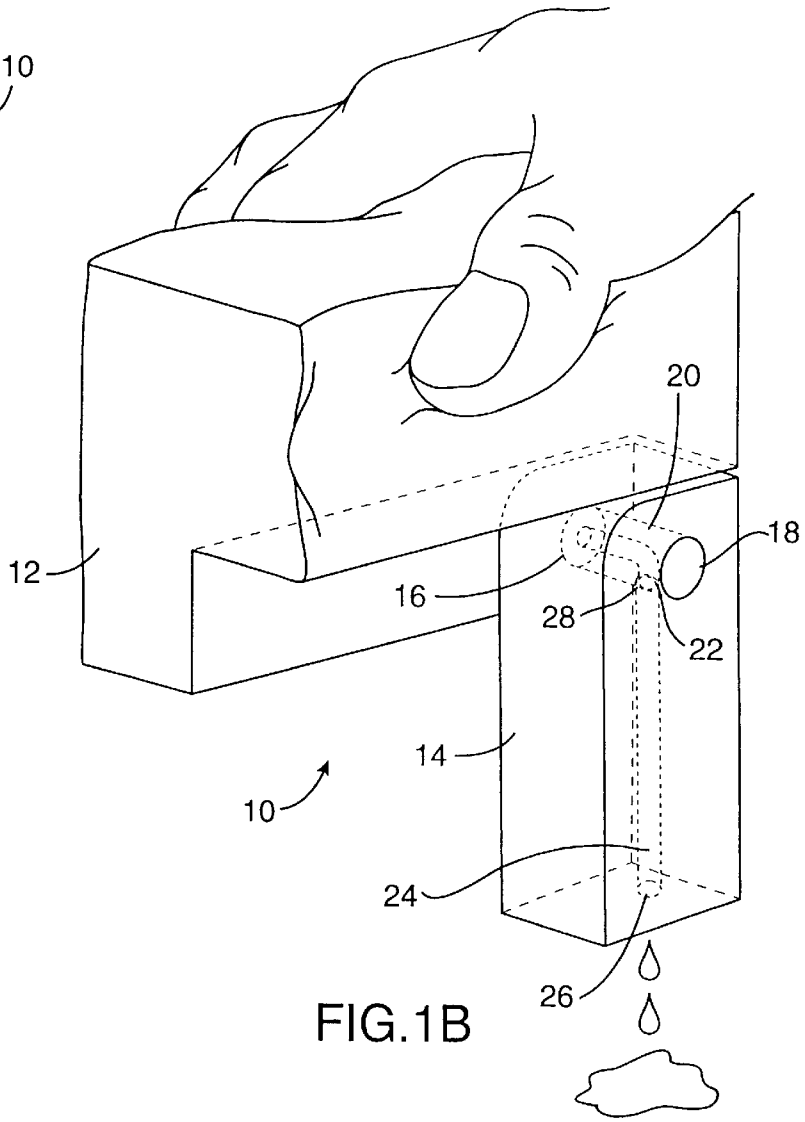
FIGS. 1A and 1B show a first embodiment of the dispensing bottle of the present invention with the pivotable dispensing tube in the closed position and open position, respectively.
Figure 1A:
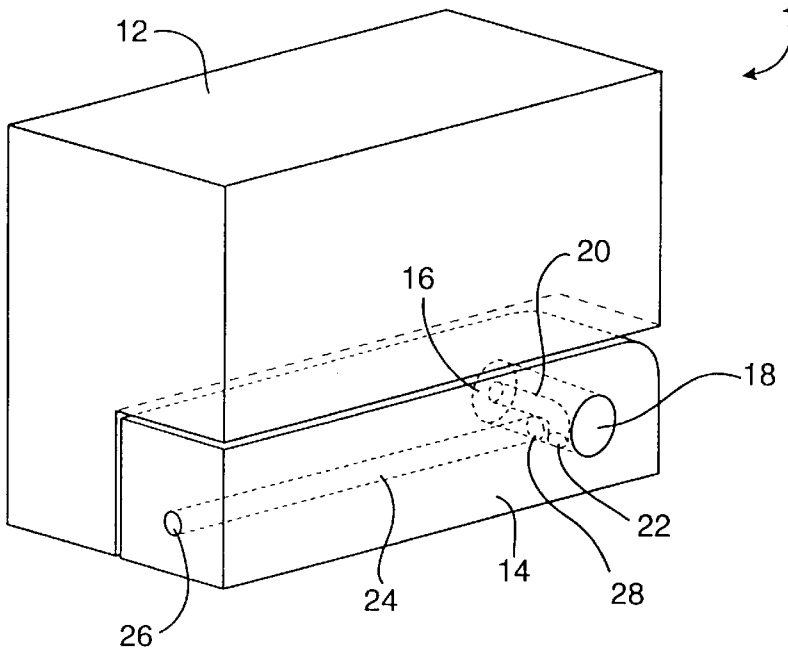
Figure 1C:
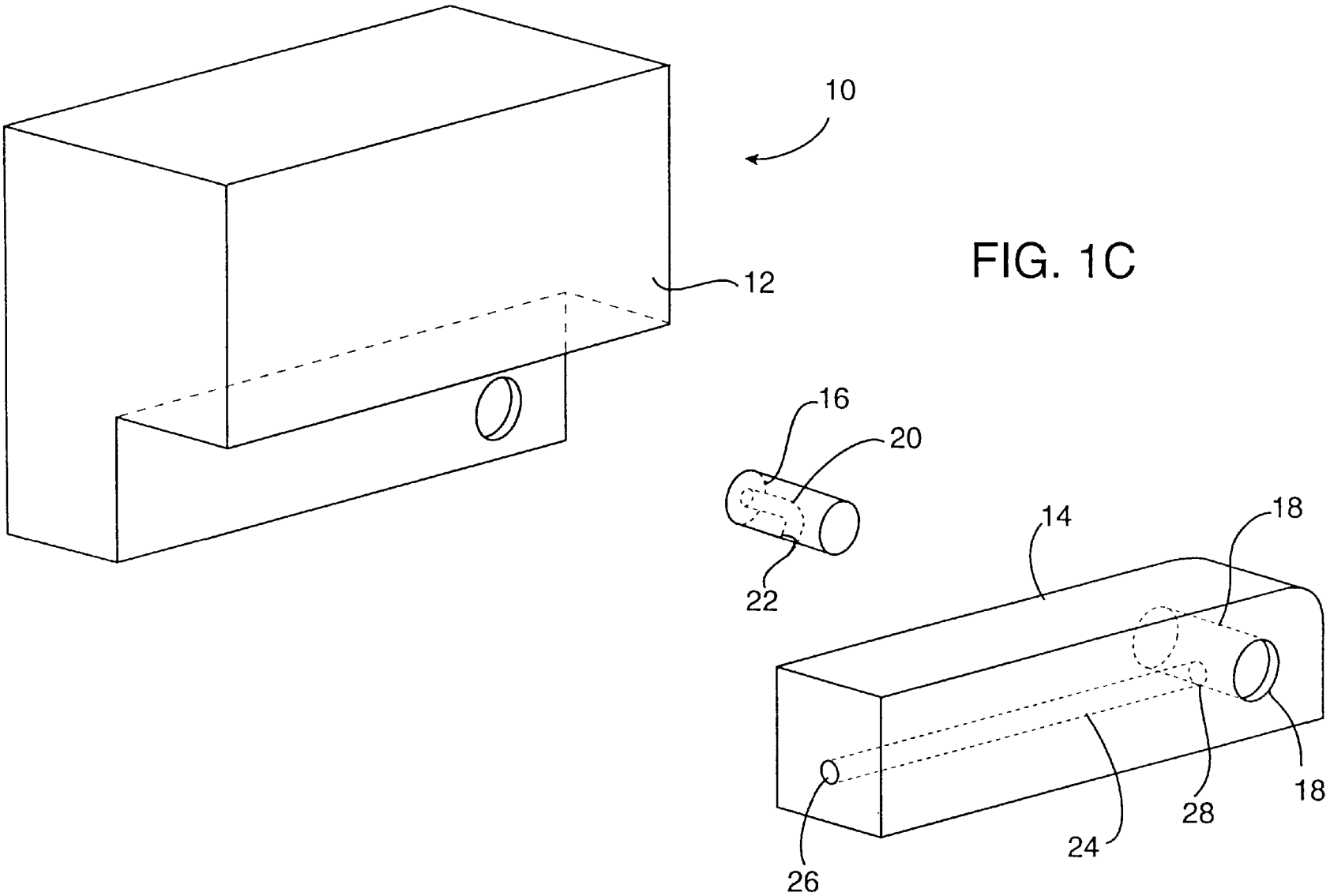
FIG. 1C is an exploded view of the dispensing bottle of FIGS. 1A and 1B.

A first embodiment of the dispensing bottle 10 of the present invention is shown in FIGS. 1A, 1B and 1C. The dispensing bottle 10 has a liquid container 12 for holding a liquid, such as liquid soap, hand lotion, etc. Preferably, the liquid container 12 portion of the dispensing bottle 10 is molded of flexible plastic material, such as polyethylene or polypropylene, using known molding techniques, such as injection molding, blow molding or rotational molding. A pivotable dispensing tube 14 is pivotably attached to the liquid container 12, preferably near the bottom of the liquid container 12. A hollow pivot pin 16 extends from the side of the liquid container 12 and engages a transverse pivot hole 18 through the pivotable dispensing tube 14. The hollow pivot pin 16 can be molded integrally with the liquid container 12 or it can be molded as a separate piece and assembled to the liquid container 12, for example by ultrasonic welding or other known joining processes, as shown in FIG. 1C. A first fluid passage 20 extends through the hollow pivot pin 16 connecting the interior of the fluid container 12 with a discharge port 22 located in the side of the hollow pivot pin 16.

A second fluid passage 24 extends through the pivotable dispensing tube 14 from the distal end 26 of the tube 14 to the transverse pivot hole 18. When the pivotable dispensing tube 14 is in the open position, as shown in FIG. 1B, the second fluid passage 24 aligns with the discharge port 22 in the side of the hollow pivot pin 16. When the pivotable dispensing tube 14 is in the closed position, as shown in FIG. 1A, the second fluid passage 24 moves out of alignment with the discharge port 22, thereby acting like a valve to close off fluid flow between the first fluid passage 20 and the second fluid passage 24. In a preferred embodiment, the second fluid passage 24 within the pivotable dispensing tube 14 is configured so that, when the pivotable dispensing tube 14 is in the closed position and the base 30 of the dispensing bottle 10 is horizontal, the distal end 26 of the second fluid passage 24 is higher than the proximal end 28. That way, when the pivotable dispensing tube 14 is closed and the dispensing bottle 10 is placed on a level surface, such as a shelf or countertop, any liquid remaining in the second fluid passage 24 tends to flow back into the passage 24 rather than flowing out the open distal end 26. This feature eliminates dripping from the dispensing bottle 10 between uses.

Figure 2:
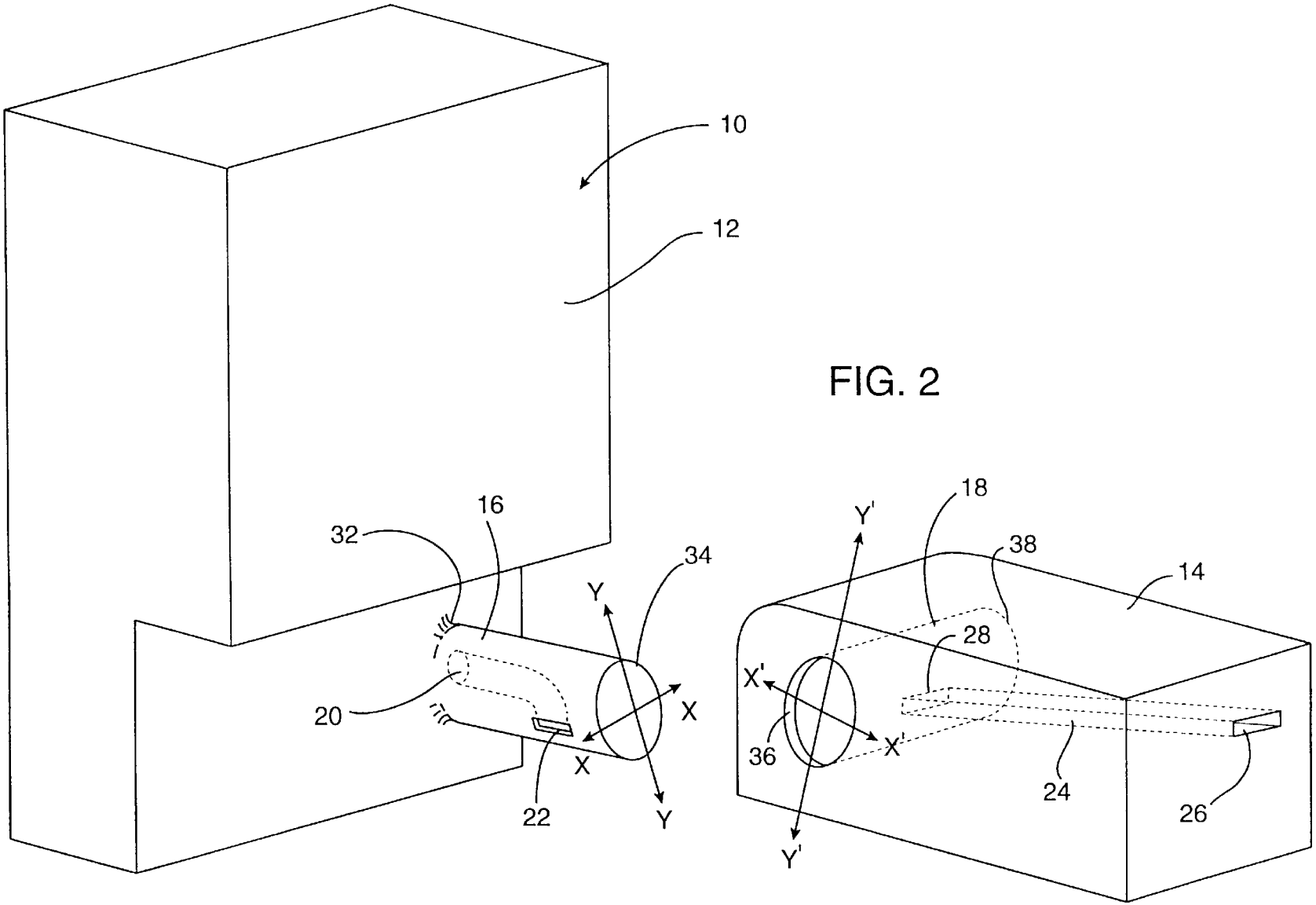
FIG. 2 is an exploded view of the dispensing bottle of the present invention showing a first embodiment of the biasing means for urging the pivotable dispensing tube into the closed position.

In a preferred embodiment of the dispensing bottle 10, the pivotable dispensing tube 14 is provided with a biasing means for urging the pivotable dispensing tube 14 to a closed position. FIGS. 2 and 3 show the dispensing bottle 10 with two preferred embodiments of the biasing means. Referring first to FIG. 2, the dispensing bottle 10 is shown in an exploded view with the pivotable dispensing tube 14 separated from the liquid container 12 to show the details of their construction. The hollow pivot pin 16 which extends from the liquid container 12 has an oval cross section which is slightly larger in the direction of the major axis Y—Y than in the direction of the minor axis X—X. In this embodiment, the Y—Y axis is inclined slightly from vertical. The angle of inclination of the axes is not critical and can be changed to facilitate manufacturability of the dispenser bottle 10 as desired. The pivotable dispensing tube 14 has a transverse pivot hole 18 which has an identical oval cross section to the hollow pivot pin 16. The major axis Y'—Y' and the minor axis X'—X' of the transverse pivot hole 18 are made in the same orientation as the major axis Y—Y and the minor axis X—X of the hollow pivot pin 16 so that the pivotable dispensing tube 14 will slide onto the hollow pivot pin 16 and be stable in the closed position.

Preferably, there are a pair of grooves 32, 34 molded into the hollow pivot pin 16, with the first groove 32 at the base of the pin 16 and the second groove 34 near the end of the pin 16. A pair of corresponding rings 36, 38 are molded into the transverse pivot hole 18 so that the pivotable dispensing tube 14 has a snap fit onto the hollow pivot pin 16. The rings 36, 38 fit into the grooves 32, 34 and retain the pivotable dispensing tube 14 on the hollow pivot pin 16 while allowing the pivotable dispensing tube 14 to pivot relative to the liquid container 12. It should be noted that the relative positions of the rings 36, 38 and grooves 32, 34 can be reversed if desired without affecting the functionality of the dispensing bottle 10. As noted above, the distal end 26 of the second fluid passage 24 within the pivotable dispensing tube 14 is positioned higher than the proximal end 28. The discharge port 22 of the first fluid passage 20 through the hollow pivot pin 16 is angled downward so that the proximal end 28 of the second fluid passage 24 is not aligned with the discharge port 22 when the pivotable dispensing tube 14 is in the closed position so that no liquid can pass from the liquid container 12 into the pivotable dispensing tube 14. When the pivotable dispensing tube 14 is rotated downward relative to the liquid container 12, the proximal end 28 of the second fluid passage 24 moves into alignment with the discharge port 22, acting like a valve to allow fluid flow between the first fluid passage 20 and the second fluid passage 24 within the pivotable dispensing tube 14.

As the pivotable dispensing tube 14 rotates downward into the open position, the major axis Y'—Y' of the oval-shaped transverse pivot hole 18 rotates out of alignment with the major axis Y—Y of the oval-shaped hollow pivot pin 16. The transverse pivot hole 18 and the hollow pivot pin 16 deform elastically as the pivotable dispensing tube 14 rotates downward, storing elastic energy. When the pivotable dispensing tube 14 is released, the stored elastic energy causes the dispensing tube 14 to rotate upward into the closed position, automatically stopping the flow of liquid through the discharge port 22 into the second fluid passage 24. Thus, the cooperation between the geometry of the oval-shaped hollow pivot pin 16 and the oval-shaped transverse pivot hole 18 act as a biasing means to urge the pivotable dispensing tube 14 into the closed position so that the closure of the dispensing bottle is self-operating.

Figure 3A:
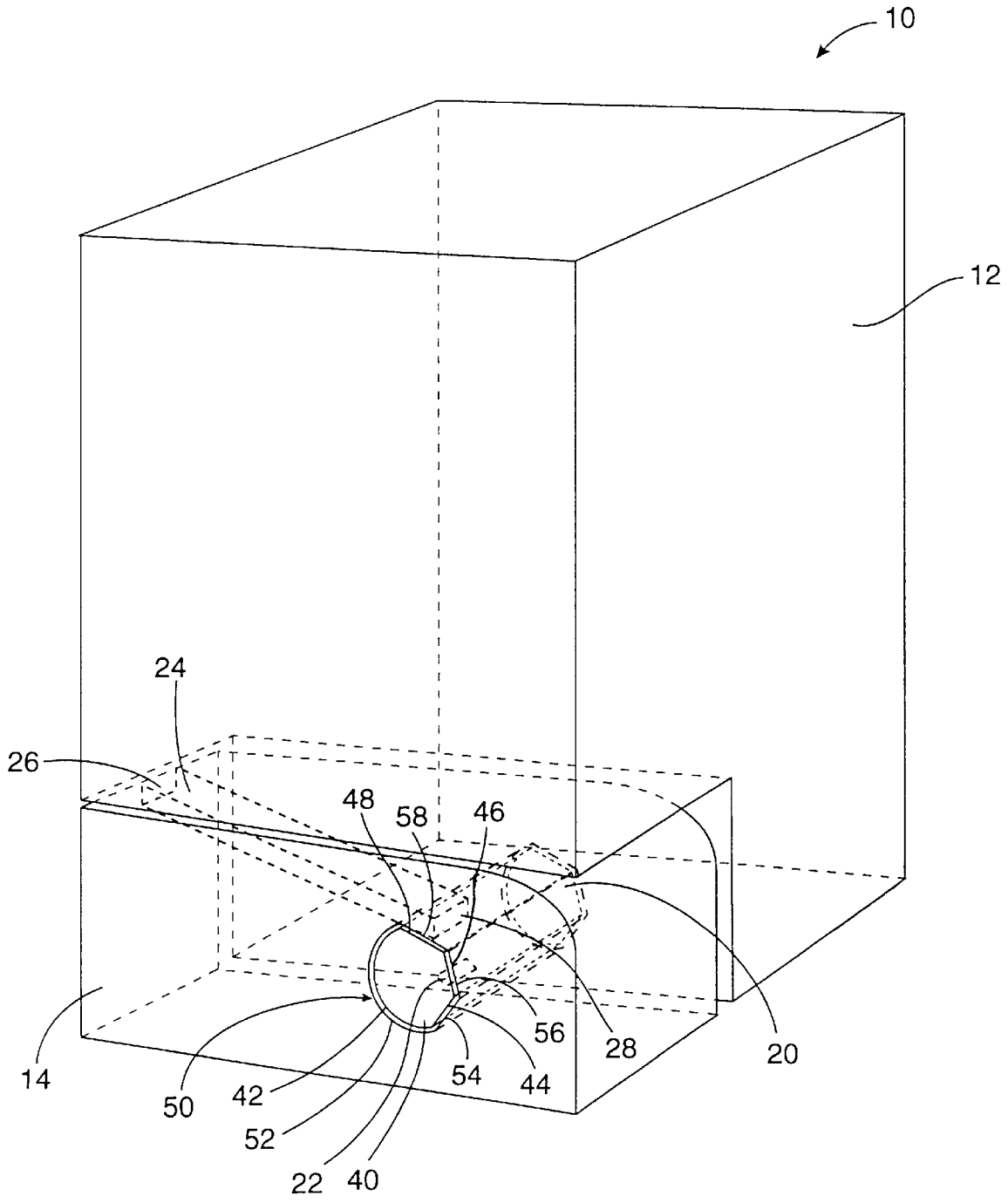
FIG. 3A is a perspective view of the dispensing bottle of the present invention showing a second embodiment of the biasing means for urging the pivotable dispensing tube into the closed position.
Figure 3B:
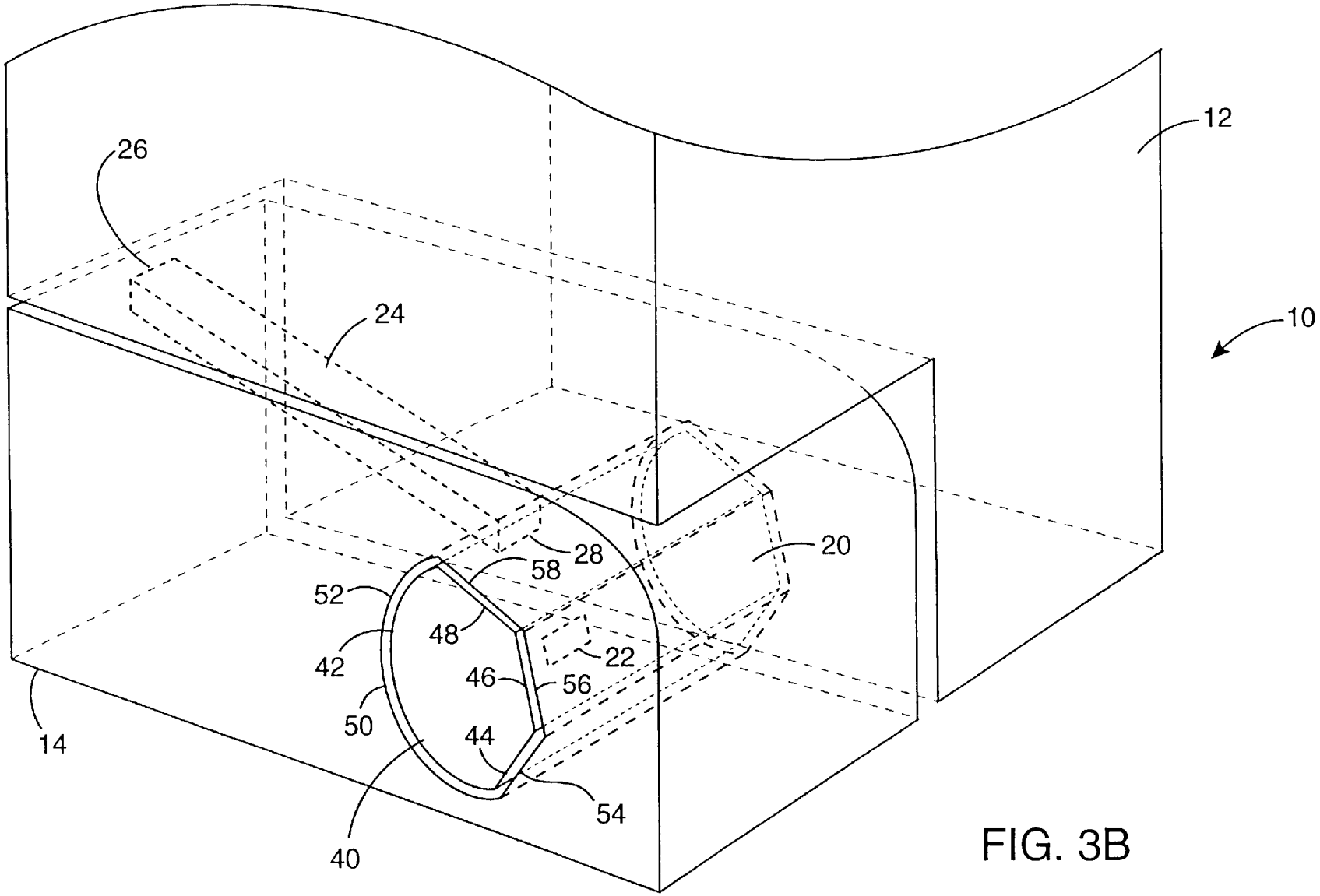
FIG. 3B is an enlarged view of the pivotable dispensing tube of the dispensing bottle of FIG. 3A.
Figure 3C:
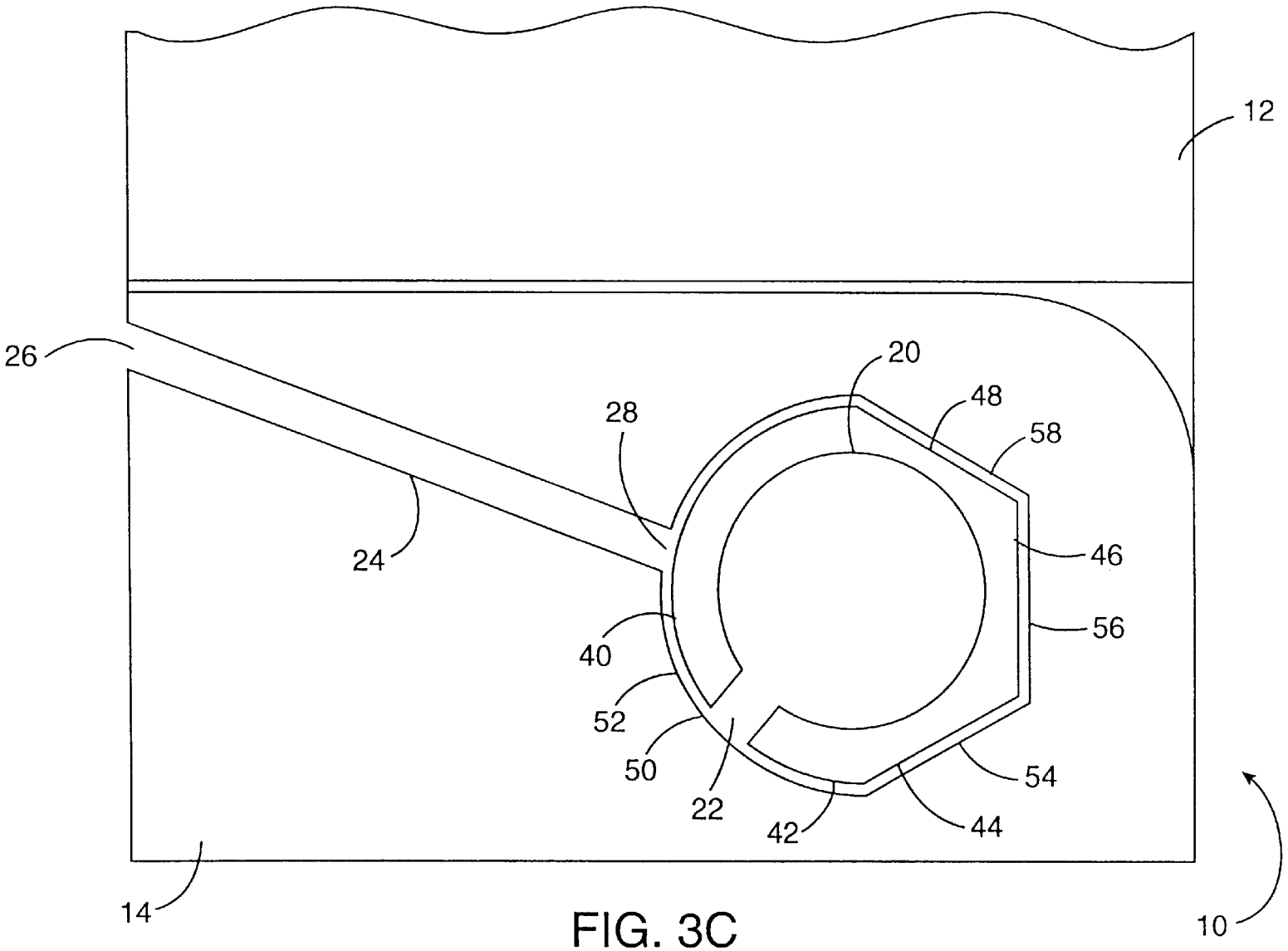
FIG. 3C is a partial cross section of the pivotable dispensing tube of FIG. 3B taken along the line 3C—3C.

The dispensing bottle 10 is shown with a second preferred embodiment of the biasing means for urging the pivotable dispensing tube 14 to a closed position in FIGS. 3A–3C. For ease of understanding, the description of this embodiment will use the same reference numbers for parts and features which are closely analogous to those in FIGS. 1A, 1B, 1C, and FIG. 2 and will assign new reference numbers to those parts and features which are significantly different. The biasing means in this embodiment has the additional feature of a detent for holding the pivotable dispensing tube 14 stable in the open position while the dispensing bottle 10 is in use. The biasing means of the self-operating closure acts to urge the pivotable dispensing tube 14 to a closed position when the dispensing tube 14 is moved past the detent, either manually or by setting the dispensing bottle 10 down on a horizontal surface.

FIG. 3A shows a perspective view of the dispensing bottle 10 with the liquid container 12 and the pivotable dispensing tube 14 assembled together. FIG. 3B shows an enlarged view of the pivotable dispensing tube 14 of the dispensing bottle of FIG. 3A. FIG. 3C is a partial cross section of the pivotable dispensing tube 14 taken along line 3C—3C in FIG. 3B. A hollow pivot pin 40 extends from the liquid container 12. The hollow pivot pin 40 has a generally cylindrical geometry with one half of the cylinder being rounded 42 and the other half having three flat sides 44, 46, 48. A transverse pivot hole 50 through the pivotable dispensing tube 14 has a matching cylindrical geometry with one half of the cylindrical hole 50 being rounded 52 and the other half having three flat sides 54, 56, 58. The discharge port 22 which connects with the first fluid passage 20 is located on the rounded side 42 of the hollow pivot pin 40. Likewise, the proximal end 28 of the second fluid passage 24 through the pivotable dispensing tube 14 is located on the rounded side 52 of the transverse pivot hole 50. When the pivotable dispensing tube 14 is rotated downward relative to the liquid container 12, the proximal end 28 of the second fluid passage 24 moves into alignment with the discharge port 22, acting like a valve to allow fluid flow between the first fluid passage 20 and the second fluid passage 24 within the pivotable dispensing tube 14.

As the pivotable dispensing tube 14 rotates downward into the open position, the three flat sides 54, 56, 58 of the transverse pivot hole 50 rotate out of alignment with the flat sides 44, 46, 48 of the hollow pivot pin 40. The transverse pivot hole 50 and the hollow pivot pin 40 deform elastically as the pivotable dispensing tube 14 rotates downward, storing elastic energy. When the pivotable dispensing tube 14 reaches the open position, two of the flat sides 54, 56 of the hollow pivot pin 40 realign with two of the flat sides 46, 48 of the hollow pivot pin 40, acting as a detent to hold the pivotable dispensing tube 14 in a quasistable open position. With the pivotable dispensing tube 14 in this quasistable open position, the user is free to dispense as much or as little of the liquid contents of the dispensing bottle 10 as is desired. When the user is through dispensing, the self-operating closure is activated by moving the pivotable dispensing tube 14 past the detent position, whereupon the stored elastic energy from the deformation of the transverse pivot hole 50 and the hollow pivot pin 40 causes the dispensing tube 14 to rotate upward into the closed position, automatically stopping the flow of liquid through the discharge port 22 into the second fluid passage 24. The pivotable dispensing tube 14 can be moved past the detent position either by manually rotating the dispensing tube 14 or by setting the dispensing bottle 10 down on a horizontal surface so that the weight of the dispensing bottle 10 and its contents forces the dispensing tube 14 past the detent position, automatically initiating the action of the self-operating closure. This feature allows for very convenient one-handed operation of the dispensing bottle 10 with its self-operating closure.

Figure 4A:
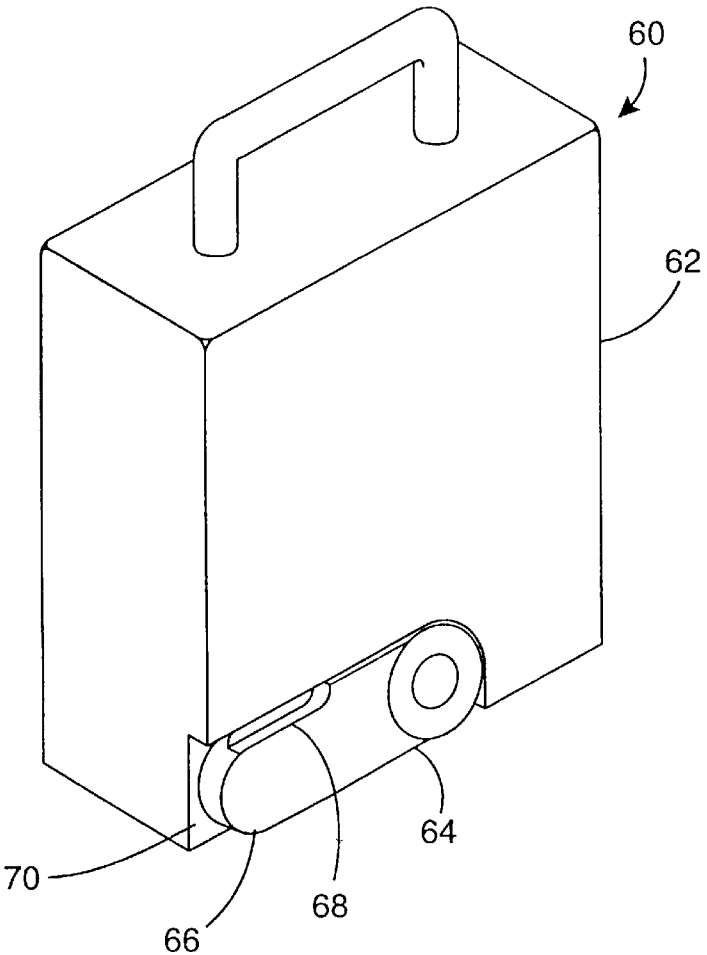
FIGS. 4A and 4B show a second embodiment of the dispensing bottle of the present invention with the pivotable dispensing tube in the closed position and open position, respectively.
Figure 4B:
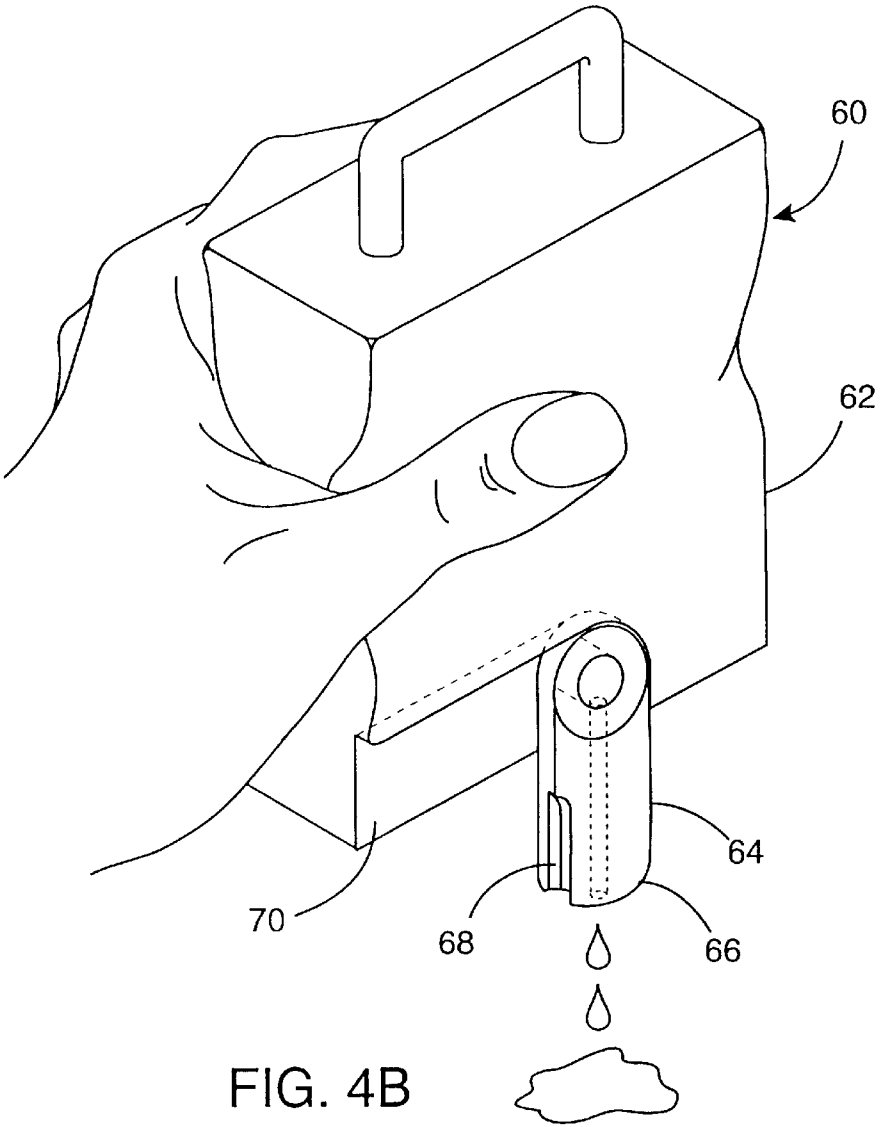

FIGS. 4A and 4B show a second embodiment of the dispensing bottle 60 of the present invention with the pivotable dispensing tube 64 in the closed position and open position, respectively. In this embodiment, the pivotable dispensing tube 64 is aesthetically integrated into the design of the liquid container 62. The pivotable dispensing tube 64 withdraws into a recess 70 within the base 72 of the liquid container 62, which aside from the aesthetic appeal also lends to the drip resistant aspect of the dispensing bottle 60. The distal end 66 of the pivotable dispensing tube 64 is rounded, which facilitates activation of the automatic closure mechanism when the dispensing bottle 60 is placed on a horizontal surface. An indentation 68 in the upper edge of the pivotable dispensing tube 64 assists the user in gripping the dispensing tube 64 to withdraw it from the recess 70 in the liquid container 62 to open the dispensing bottle 60. Either of the biasing means discussed above in connection with FIGS. 2 and 3, or other functional equivalents, can be used in conjunction with this design.

Alternatively, the biasing means for urging the pivotable dispensing tube 74 into the closed position can be provided by the weight of the dispensing bottle 60 and its contents. To facilitate this gravity-activated self-operating closure mechanism, the dispensing bottle 60 should be provided with a low friction pivoting connection between the pivotable dispensing tube 74 and the liquid container 72 and, when it is in the open position, the pivotable dispensing tube 74 should form an acute angle with respect to the base of the liquid container, as shown in FIG. 4B. The rounded distal end 66 of the pivotable dispensing tube 64 in this embodiment also assists this gravity-activated self-operating closure action.

Figure 5B:
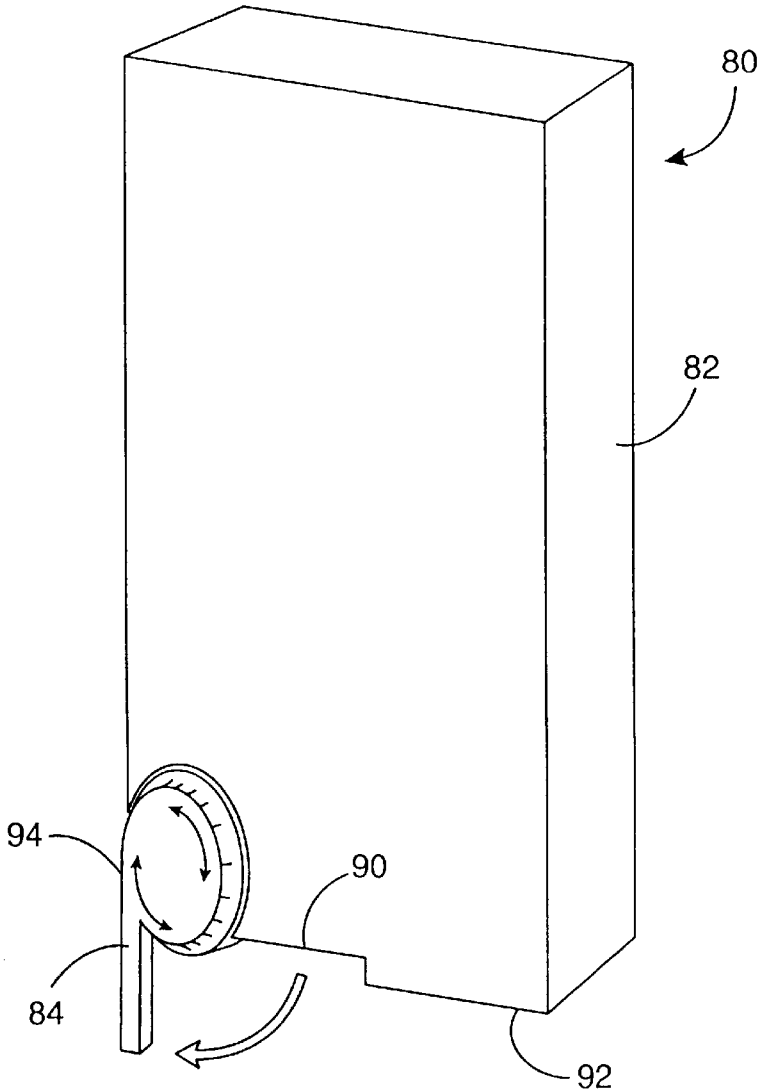
FIGS. 5A and 5B show a third embodiment of the dispensing bottle of the present invention with the pivotable dispensing tube in the closed position and open position, respectively.
Figure 5A:
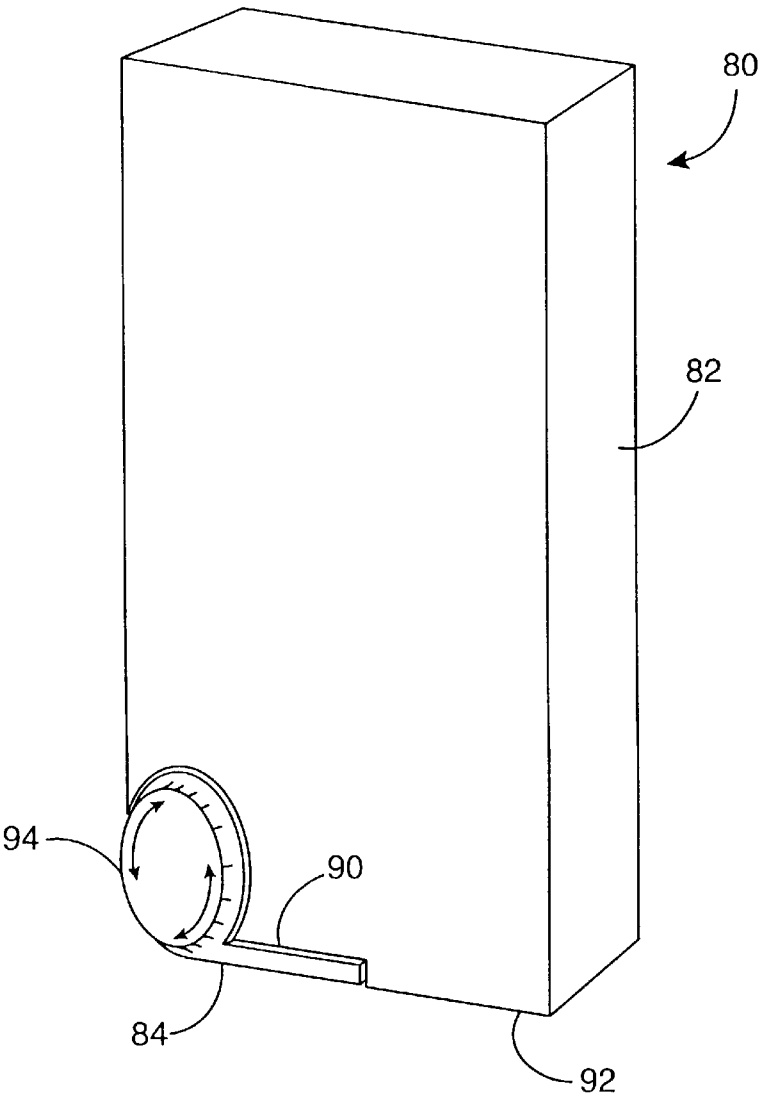

FIGS. 5A and 5B show a third embodiment of the dispensing bottle 80 of the present invention with the pivotable dispensing tube 84 in the closed position and open position, respectively. In this embodiment, an L-shaped pivotable dispensing tube 84 is integrated into the design of the liquid container 82. The pivotable dispensing tube 84 withdraws into a recess 90 within the base 92 of the liquid container 82. In order to facilitate withdrawal of the pivotable dispensing tube 84 from the recess 90 in the liquid container 82 to open the dispensing bottle 80, a knob or dial 94 is integrated into the pivoting end of the dispensing tube 84. The dial 94 can be used to open the pivotable dispensing tube 84 manually and any one of the biasing means discussed above in connection with FIGS. 2, 3, 4A and 4B, or other functional equivalents, can be used to automatically close the dispenser bottle 80 after the desired amount of liquid has been dispensed.

Figure 6A:
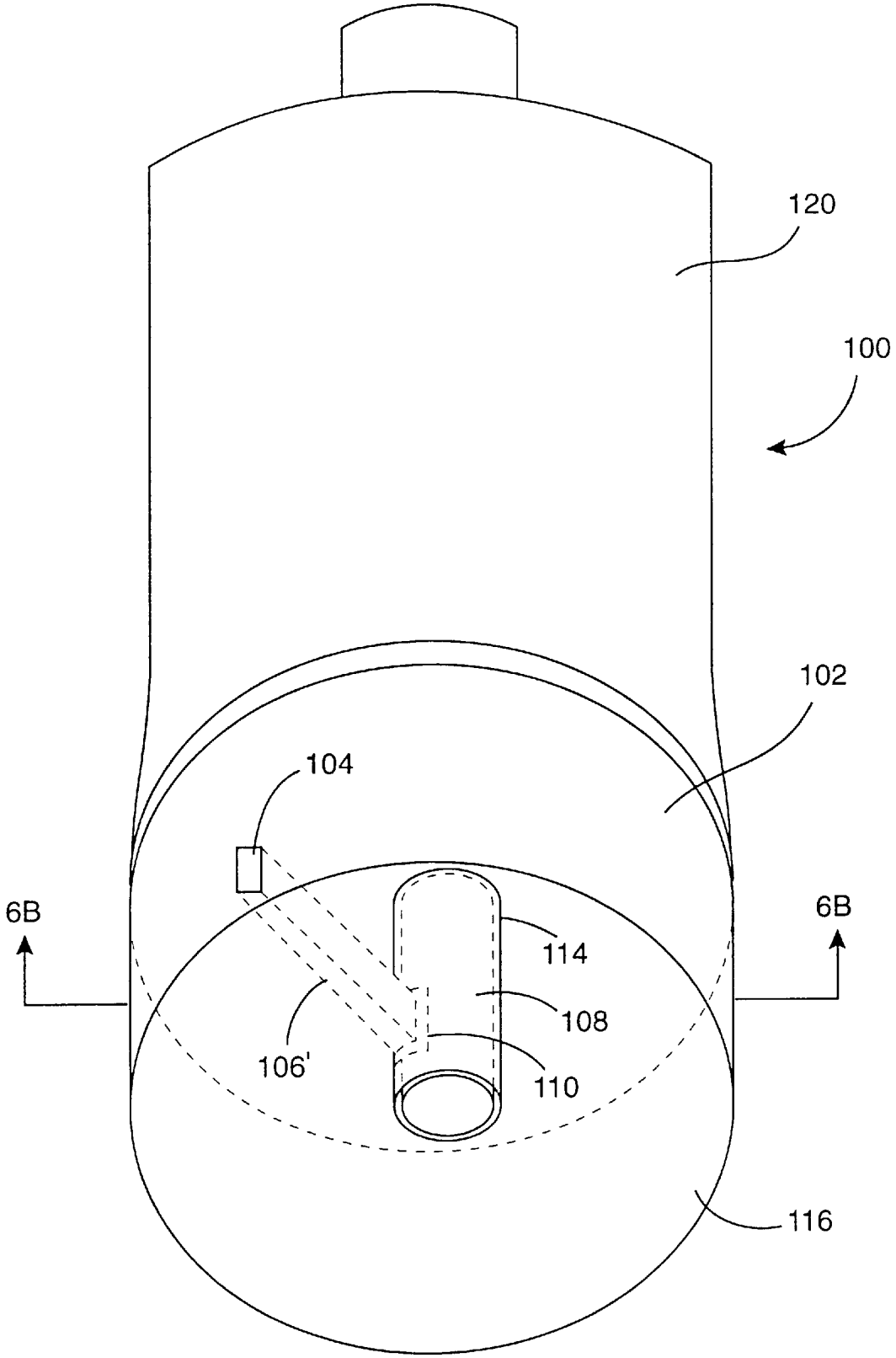
FIG. 6A shows a perspective view of a fourth embodiment of the dispensing bottle of the present invention with the dispensing tube incorporated into a disk-shaped rotating dispensing spout.
Figure 6B:
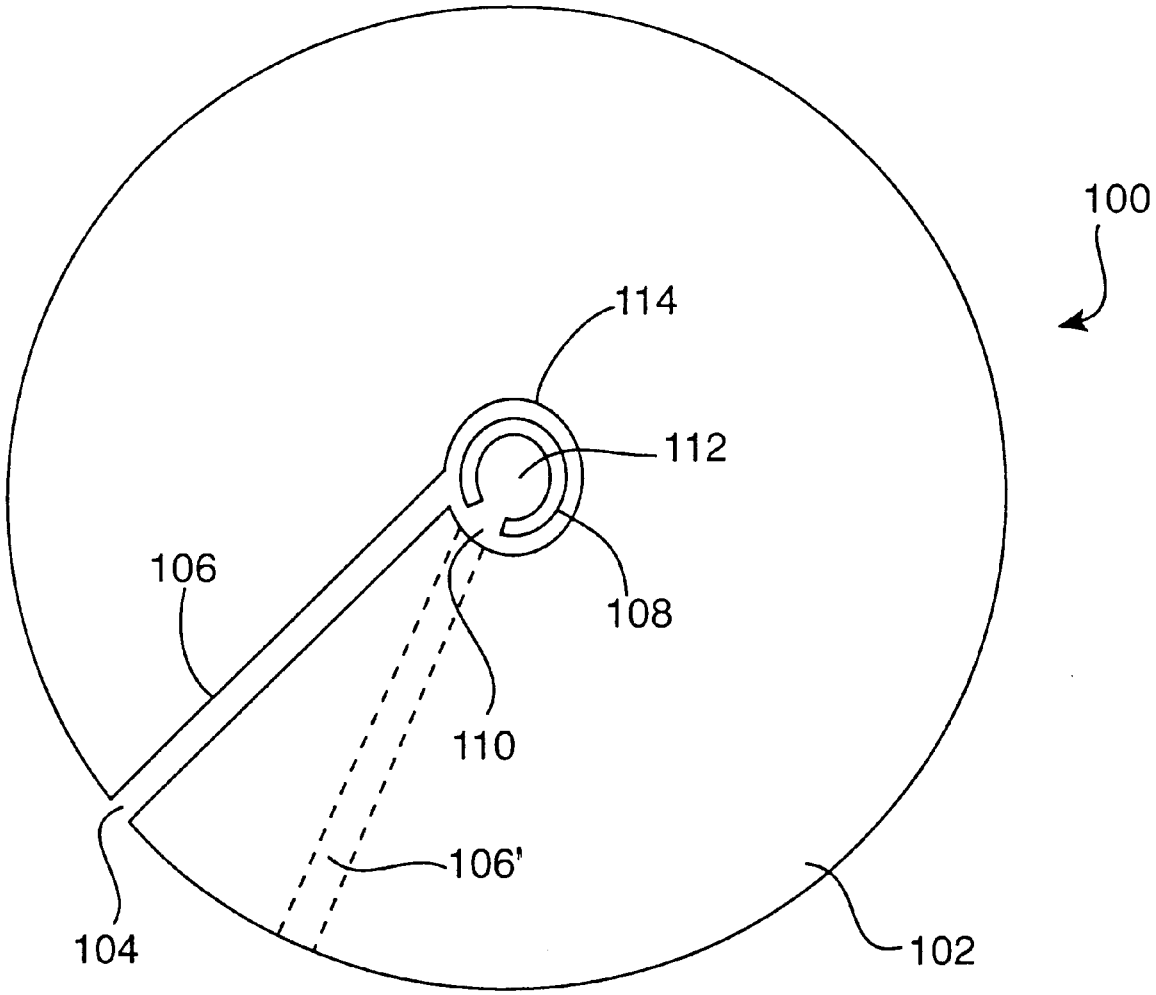
FIG. 6B is a cross section of the dispensing bottle of FIG. 6A taken along the line 6B—6B.

FIG. 6A shows a perspective view of a fourth embodiment of the dispensing bottle 100 of the present invention with the dispensing tube 106 incorporated into a disk-shaped rotating dispensing spout 102. FIG. 6B is a cross section of the dispensing bottle 100 of FIG. 6A taken along the line 6B—6B. The dispensing bottle 100 has a liquid container 120 for holding a liquid to be dispensed. A hollow pivot pin 108 extends from the bottom of the liquid container 120. A first fluid passage 112 extends through the hollow pivot pin 108 connecting the interior of the fluid container 120 with a discharge port 110 located in the side of the hollow pivot pin 108. A disk-shaped rotating dispensing spout 102 is rotatably mounted on the bottom of the liquid container 120. A pivot hole 114 through the disk-shaped rotating dispensing spout 102 engages the hollow pivot pin 108. A second fluid passage 106 which acts as a dispensing tube extends through the body of the disk-shaped rotating dispensing spout 102 from the pivot hole 114 to a dispensing port 104 on the exterior of the dispensing spout 102. When the disk-shaped rotating dispensing spout 102 is in the open position, as shown in FIG. 6A, the second fluid passage 106 aligns with the discharge port 110 in the side of the hollow pivot pin 108. When the disk-shaped rotating dispensing spout 102 is in the closed position, as shown in FIG. 6B, the second fluid passage 106 moves out of alignment with the discharge port 110, thereby acting like a valve to close off fluid flow between the first fluid passage 112 and the second fluid passage 106.

In a preferred embodiment, the second fluid passage 106 within the disk-shaped rotating dispensing spout 102 is configured so that the second fluid passage 106 is inclined upward from the discharge port 110 on the hollow pivot pin 108 to the dispensing port 104 on the exterior of the dispensing spout 102. That way, when the dispensing bottle 100 is placed on a level surface, such as a shelf or countertop, any liquid remaining in the second fluid passage 106 tends to flow back into the passage 106 rather than flowing out the open dispensing port 104. This feature eliminates dripping from the dispensing bottle 100 between uses.

The disk-shaped rotating dispensing spout 102 is made self-closing by incorporating a biasing means, such as those described above, into the dispensing bottle 100. An exemplary embodiment of the disk-shaped rotating dispensing spout 102 incorporating a biasing means is shown in cross section in FIG. 6B. The hollow pivot pin 108 extending from the bottom of the liquid container 120 is made with a slightly oval cross section. The pivot hole 114 through the disk-shaped rotating dispensing spout 102 is made with an oval cross section which matches the oval shape of the hollow pivot pin 108 when the disk-shaped rotating dispensing spout 102 is in the closed position as depicted by the second fluid passage drawn in solid lines 106. When the disk-shaped rotating dispensing spout 102 is rotated to the open position, as depicted by the second fluid passage drawn in phantom lines 106', the hollow pivot pin 108 and/or the pivot hole 114 must deform as their oval shapes rotate out of alignment, storing up elastic energy. When the disk-shaped rotating dispensing spout 102 is released, the stored elastic energy causes it to rotate back to the closed position.

If desired, a detent to hold the disk-shaped rotating dispensing spout 102 in the open position, such as the one described in connection with FIGS. 3A–3C, may be incorporated into the dispensing bottle 100. After opening, the disk-shaped rotating dispensing spout 102 will remain in a quasistable open position until the self-operating closure is activated by rotating the dispensing spout 102 past the detent position to release the stored elastic energy which causes the dispensing spout 102 to rotate into the closed position.

In another configuration based on the embodiment of FIG. 6A, the hollow pivot pin 108 and the pivot hole 114 are molded with coacting spiral or ramp-shaped cam surfaces that cause the disk-shaped rotating dispensing spout 102 to move downward from the liquid container 120 as it is rotated to the open position. Thus, the center of gravity of the dispensing bottle 100 is slightly elevated when the disk-shaped rotating dispensing spout 102 is in the open position, thereby storing potential energy. In addition, the hollow pivot pin 108 and/or the pivot hole 114 may deform as the disk-shaped rotating dispensing spout 102 rotates to store up elastic energy as well. A detent molded into the hollow pivot pin 108 and the pivot hole 114 holds the disk-shaped rotating dispensing spout 102 in the open position. When the dispensing bottle 100 is placed on a horizontal surface, the weight of the dispensing bottle 100 and its contents forces the disk-shaped rotating dispensing spout 102 past the detent position to release the stored potential and/or elastic energy which causes the dispensing spout 102 to rotate into the closed position.

The dispensing bottle embodiment of FIGS. 6A–6B has an additional advantage in that the center of gravity of the liquid container 120 is always over the supporting bottom surface 116 of the disk-shaped rotating dispensing spout 102 in the open and closed positions, lending to the stability of the dispensing bottle 100.

Figure 6C:
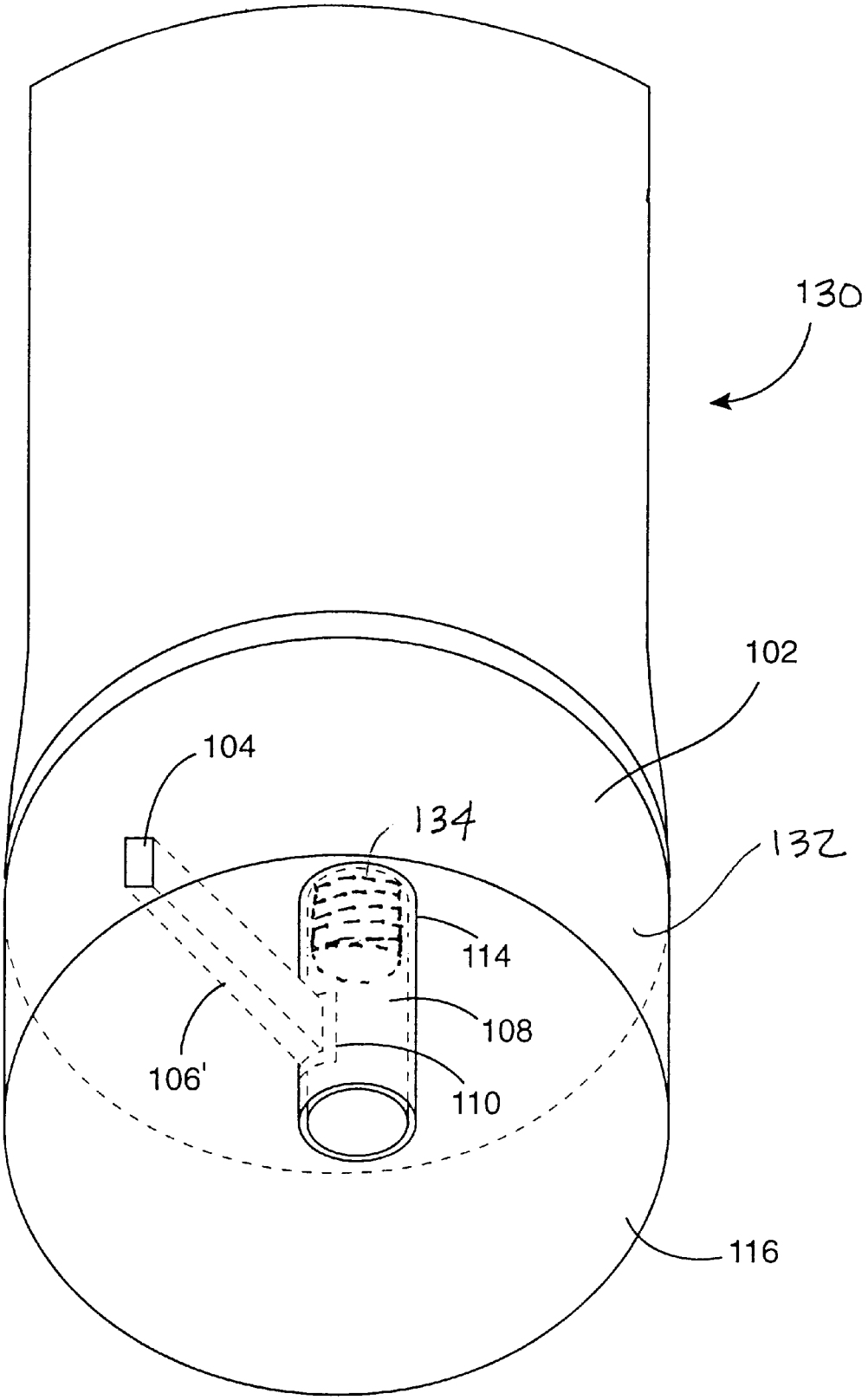
FIG. 6C shows a variation of the fourth embodiment configured to be attached to a standard threaded-neck bottle.

FIG. 6C shows a perspective view of a variation of the fourth embodiment 130. The dispensing spout 102 is of a similar configuration to the basic dispensing bottle 100. However, the dispensing spout 102 is a separate cap 132 which may be screwed onto the threaded neck 134 of a standard bottle. This allows the cap 132 to be installed onto a standard bottle to convert the bottle into a bottom dispensing design.

Figure 7B:
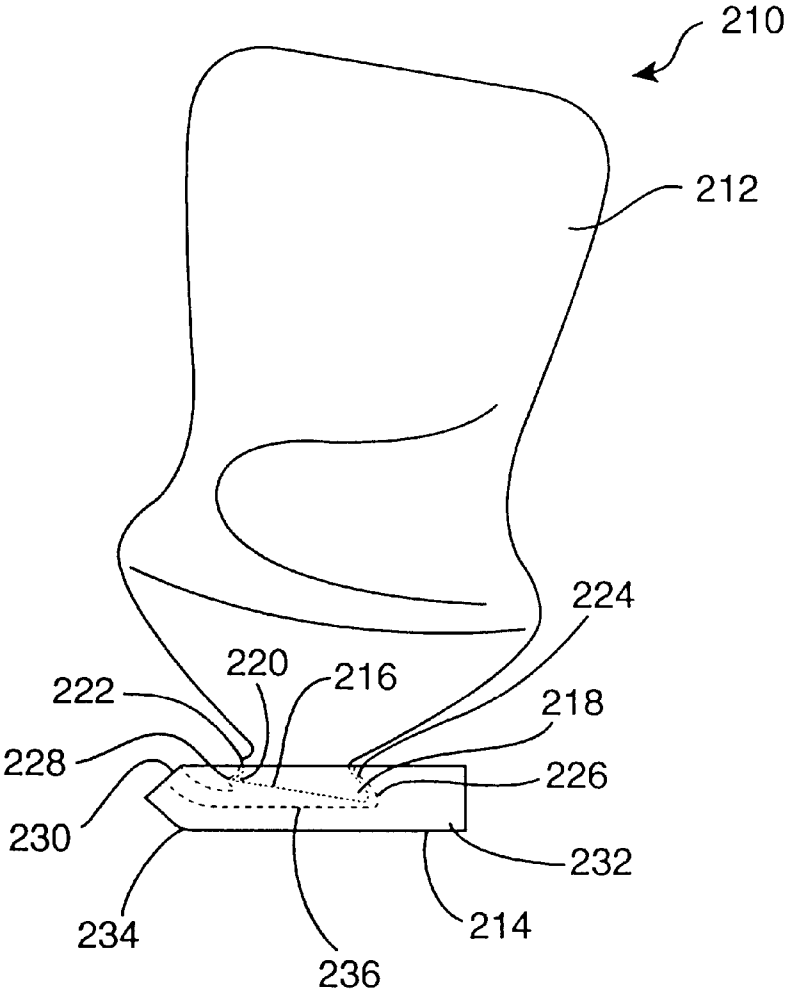
FIGS. 7A and 7B show a fifth embodiment of the dispensing bottle of the present invention with the pivotable dispensing tube in the closed position and open position, respectively.
Figure 7A:
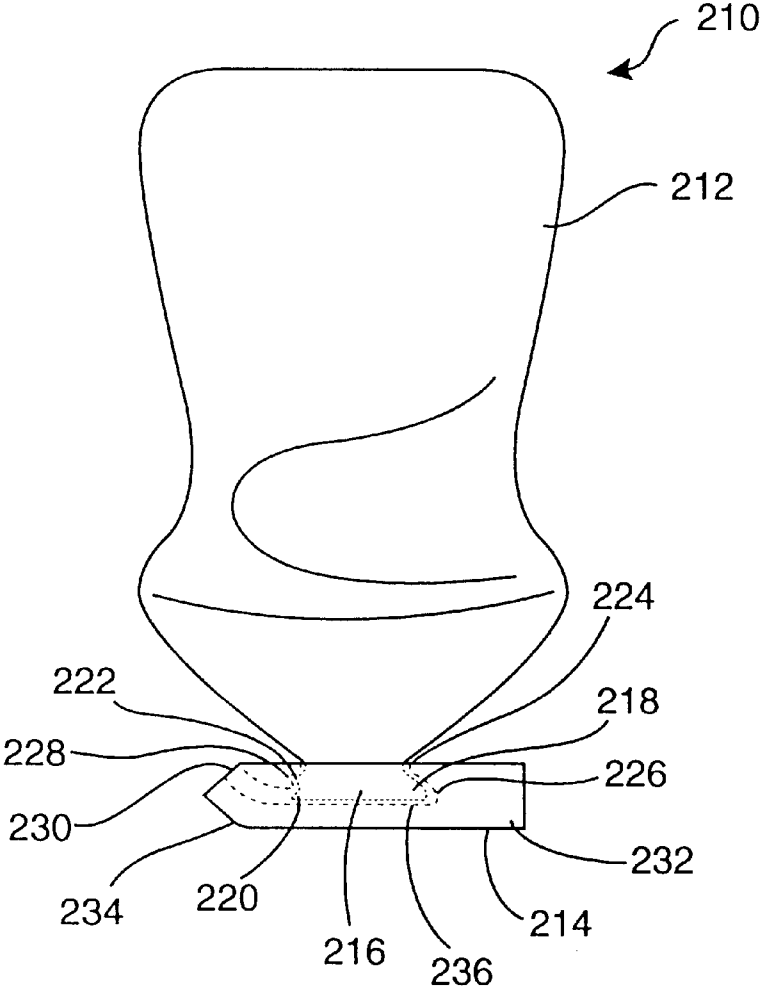

A fifth embodiment of the dispensing bottle 210 of the present invention is shown in FIGS. 7A and 7B. The dispensing bottle 210 has a liquid container 212 molded of a flexible plastic material for holding a liquid. A pivotable dispensing cap 214 is pivotably attached to the mouth 216 of the liquid container 212, which is preferably located at the bottom of the liquid container 212. The mouth 216 of the liquid container 212 is shaped with a ridge around it forming, at the back edge, a heel 218 and, at the front edge, a toe 220. Above the toe 220 on the front edge of the mouth 216 of the liquid container 212 is a second ridge forming a male detent 222.

The pivotable dispensing cap 214 is formed with a recess 224 that is shaped to sealingly engage the mouth 216 of the liquid container 212. The recess 224 has an internal groove 226 which engages the heel 218 and the toe 220 on the mouth 216 of the liquid container 212 when the pivotable dispensing cap 214 is in the closed position, as shown in FIG. 7A. Above the internal groove 226 is a second groove forming a female detent 228 which, in the closed position, engages the male detent 222 on the mouth 216 of the liquid container 212. The pivotable dispensing cap 214 has a fluid passage 230 which is preferably inclined upward so that any liquid remaining in the fluid passage 230 after dispensing tends to flow back into the fluid passage 230 to prevent dripping from the dispensing bottle 210 between uses. When the pivotable dispensing cap 214 is in the closed position as shown in FIG. 7A, the mouth 216 of the liquid container 212 is sealed by the bottom 236 of the recess 224 and the fluid passage 230 is sealed by the toe 220 on the mouth 216 of the liquid container 212. Optionally, the recess 224 within the pivotable dispensing cap 214 may include a raised annular seal (not shown) or other feature to securely seal the mouth 216 of the liquid container 212 in the closed position.

When the pivotable dispensing cap 214 is pivoted to the open position as shown in FIG. 7B, the toe 220 on the mouth 216 of the liquid container 212 engages the female detent 228 within the recess 224 of the pivotable dispensing cap 214 and the fluid passage 230 is open so that liquid can flow from the mouth 216 of the liquid container 212 and out the fluid passage 230. The pivotable dispensing cap 214 can be pivoted to the open position by pressing on the tail 232 which extends from the back of the pivotable dispensing cap 214. The desired amount of liquid can then be dispensed by squeezing the flexible liquid container 212. After dispensing, the pivotable dispensing cap 214 can be closed by pressing on the nose 234 of the pivotable dispensing cap 214 which is under the discharge end of the fluid passage 230. Optionally, the dispensing bottle 210 may include a locking mechanism to prevent the pivotable dispensing cap 214 from being inadvertently pivoted to the open position during storage or transport. In addition, the dispensing bottle 210 may also include a biasing means for urging the pivotable dispensing cap 214 into the closed position, as described above in connection with the other embodiments of the invention.

Figure 8B:
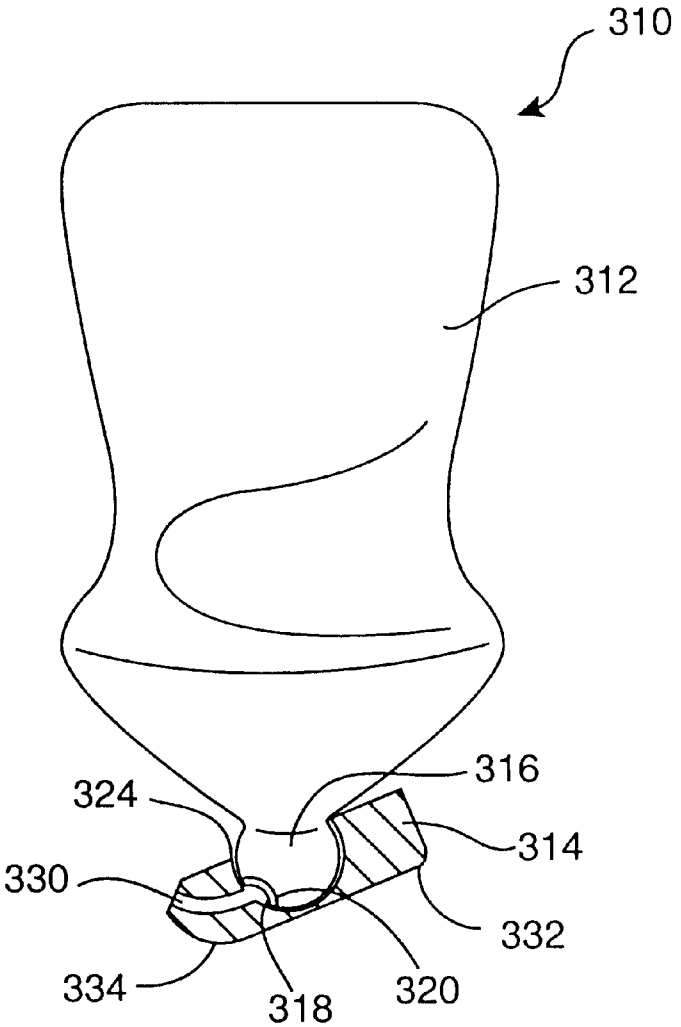
FIGS. 8A and 8B show a sixth embodiment of the dispensing bottle of the present invention with the pivotable dispensing tube in the closed position and open position, respectively.
Figure 8A:
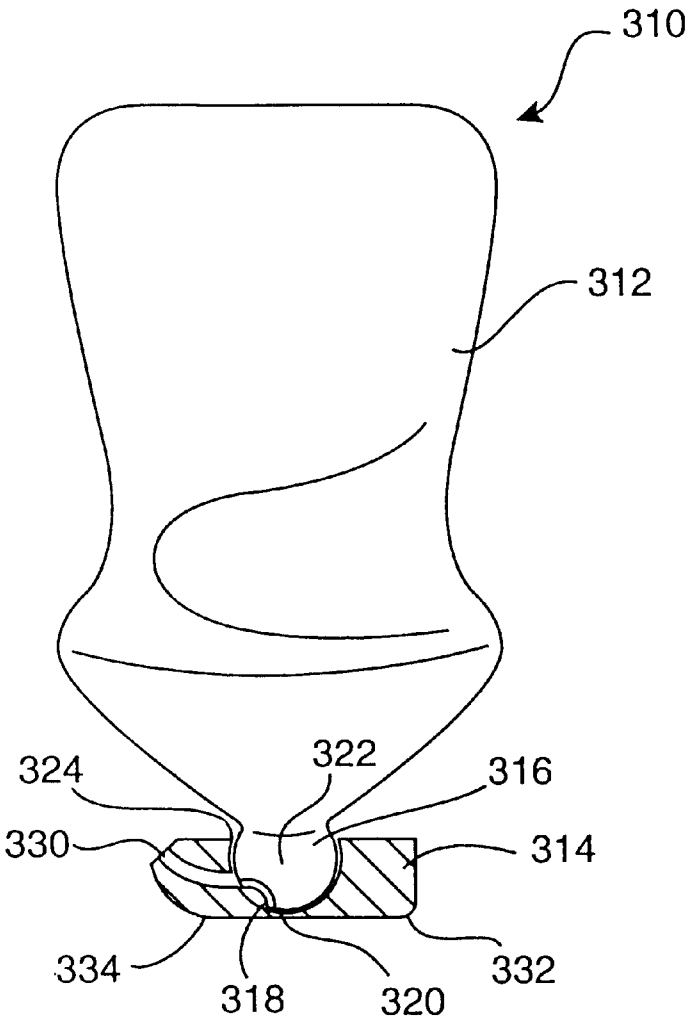

A sixth embodiment of the dispensing bottle 310 of the present invention is shown in FIGS. 8A and 8B. The dispensing bottle 310 has a liquid container 312 molded of a flexible plastic material for holding a liquid. A pivotable dispensing cap 314 is pivotably attached to the mouth 316 of the liquid container 312, which is preferably located at the bottom of the liquid container 312. Attached to the mouth 316 of the liquid container 312 is a pivot 322 in the shape of a sphere or, alternatively, a cylinder. The spherical or cylindrical pivot 322 may be molded integrally with the liquid container 312 or it may be molded as a separate piece which screws onto the mouth 316 of the liquid container 312. A first fluid passage 318 connects to the mouth 316 of the liquid container 312 and discharges from the spherical or cylindrical pivot 322. A raised O-ring seal 320 surrounds the discharge opening of the first fluid passage 318. Preferably, the raised O-ring seal 320 is integrally molded with the spherical or cylindrical pivot 322 on the mouth 316 of the liquid container 312.

The pivotable dispensing cap 314 is formed with a recess 324 that is shaped to have a snap fit with the spherical or cylindrical pivot 322 on the mouth 316 of the liquid container 312. The pivotable dispensing cap 314 has a second fluid passage 330 which is preferably inclined upward so that any liquid remaining in the fluid passage 330 after dispensing tends to flow back into the fluid passage 330 to prevent dripping from the dispensing bottle 310 between uses. When the pivotable dispensing cap 314 is in the closed position as shown in FIG. 8A, the interior surface of the recess 324 sealingly engages the raised O-ring seal 320 on the spherical or cylindrical mouth 316, preventing any liquid from flowing out of the liquid container 312.

When the pivotable dispensing cap 314 is pivoted to the open position as shown in FIG. 8B, the second fluid passage 330 in the pivotable dispensing cap 314 aligns with the first fluid passage 318 in the spherical or cylindrical pivot 322 so that liquid can flow from the mouth 316 of the liquid container 312 and out the fluid passage 330. The pivotable dispensing cap 314 can be pivoted to the open position by pressing on the tail 332 which extends from the back of the pivotable dispensing cap 314. The desired amount of liquid can then be dispensed by squeezing the flexible liquid container 312. After dispensing, the pivotable dispensing cap 314 can be closed by pressing on the nose 334 of the pivotable dispensing cap 314 which is under the discharge end of the fluid passage 330. Optionally, the dispensing bottle 310 may include a detent or locking mechanism to prevent the pivotable dispensing cap 314 from being inadvertently pivoted to the open position during storage or transport. In addition, the dispensing bottle 310 may also include a biasing means for urging the pivotable dispensing cap 314 into the closed position, as described above in connection with the other embodiments of the invention.

Figure 8C:
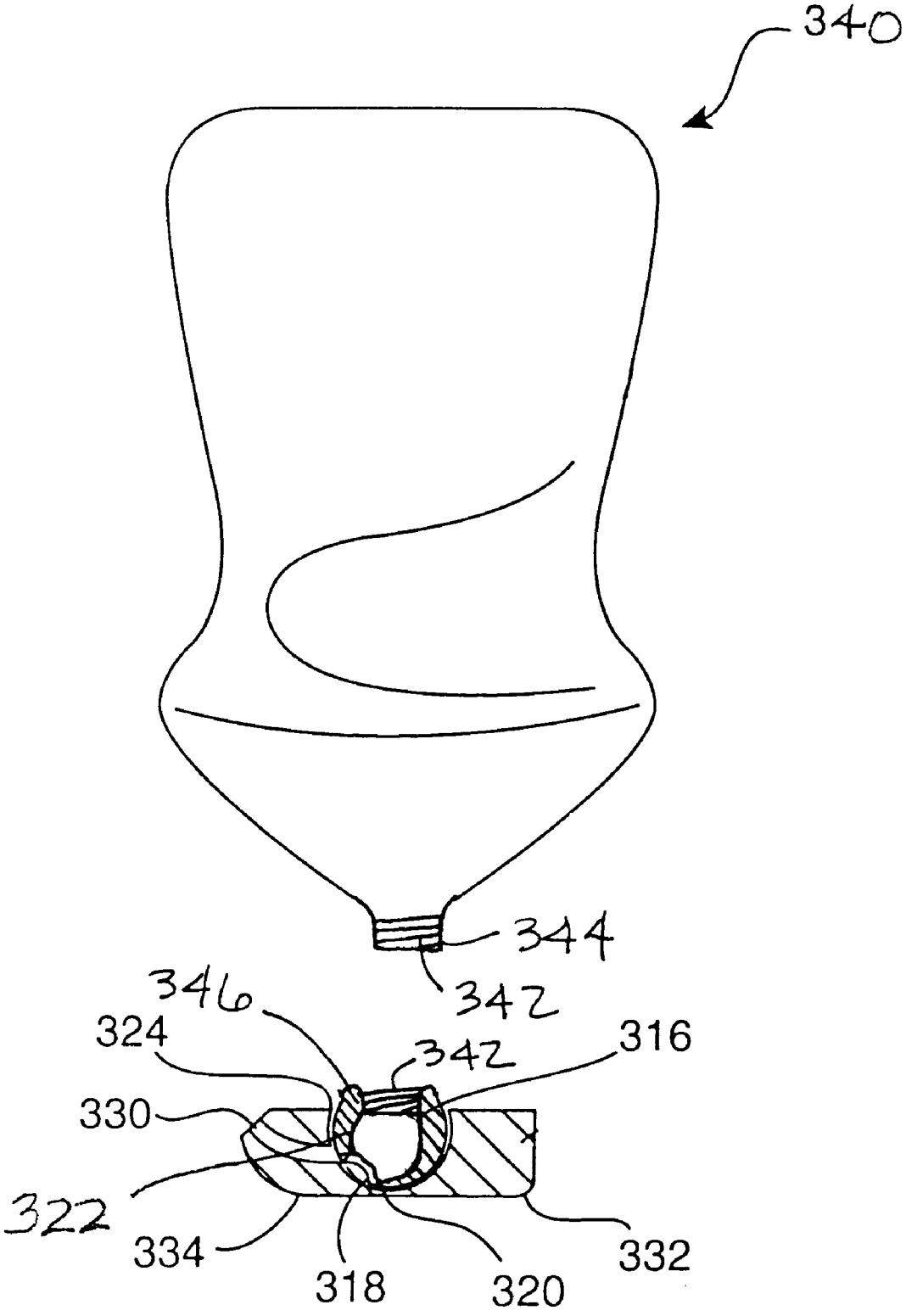
FIG. 8C shows a variation of the sixth embodiment configured to be attached to a standard threaded-neck bottle.

FIG. 8C shows an exploded view of a variation of the sixth embodiment 340. The fluid passage 330 is of a similar configuration to the basic dispensing bottle 310. However, the fluid passage 330 is a separate cap 346 which may be screwed onto the threaded portion 342 of a neck 344 of a standard bottle. This allows the cap 346 to be installed onto a standard bottle to convert the bottle into a bottom dispensing design. Other methods may also be used to install the cap 346 onto a bottle, for example snap-on caps or other mechanical interference fits may be used for this and other embodiments.

FIGS. 9A, 9B and 9C illustrate the one-handed operation of the fifth embodiment of the dispensing bottle 210 which is shown in FIGS. 7A and 7B. The following operational description is equally applicable to the sixth embodiment of the dispensing bottle 310 which is shown in FIGS. 8A and 8B.

Between uses, the dispensing bottle 210 of the present invention is stored in an inverted position with the pivotable dispensing cap 214 resting on a horizontal surface so that the liquid contained will settle into the mouth 216 of the liquid container 212 by gravity. To operate the dispensing bottle 210, the user grasps the liquid container 212 and lifts the dispensing bottle 210, then pushes the tail 232 which extends from the back of the pivotable dispensing cap 214 down onto a stationary surface 250, such as a countertop, a sink or a shelf, as shown in FIG. 9A. This pivots the pivotable dispensing cap 214 to the open position. The desired amount of liquid can then be dispensed by squeezing the flexible liquid container 212, as shown in FIG. 9B. When a sufficient amount of liquid has been dispensed, the pivotable dispensing cap 214 is reclosed by pressing on the nose 234 of the pivotable dispensing cap 214, which is under the discharge end of the fluid passage 230, down onto the stationary surface 250, as shown in FIG. 9C. This pivots the pivotable dispensing cap 214 back to the closed position. Because the fluid passage 230 in the pivotable dispensing cap 214 is inclined upward any liquid remaining in the fluid passage 230 after dispensing tends to flow back into the fluid passage 230 to prevent dripping from the dispensing bottle 210 between uses.

Although the examples given include many specificities, they are intended as illustrative of only some of the possible embodiments of the invention. Other embodiments and modifications will, no doubt, occur to those skilled in the art. For example, although the various detailed embodiments of the invention have been described as integrating the self-operating closure into the bottom of an upstanding container, it is also envisioned that the various features of the self-operating closure can be integrated into the cap of a self-standing squeeze tube container or other inverted container to achieve the same function. Although only two of the embodiments have been shown with the closure as a separate cap, other embodiments could also be modified in this manner. Thus, the examples given should only be interpreted as illustrations of some of the preferred embodiments of the invention, and the full scope of the invention should be determined by the appended claims and their legal equivalents.

I claim:

1. A dispensing bottle comprising:

a liquid container having an interior for storage of the liquid; and a dispensing means in fluid connection with said interior of said liquid container, said dispensing means having an open position and a closed position and a first urging means for urging said dispensing means from said open position to said closed position, wherein said dispensing means is a dispensing cap and wherein substantially all of said dispensing cap is tiltable between said closed position and said open position.

2. The dispensing bottle of claim 1 wherein said interior of said liquid container has a bottom surface and said dispensing means is in fluid connection with said interior of said liquid container proximate said bottom surface.

3. The dispensing bottle of claim 1 wherein said dispensing means is a one-piece dispensing cap.

4. The dispensing bottle of claim 3 wherein said one-piece dispensing cap is a single substantially semi-rigid piece.

5. A dispensing bottle comprising:

a liquid container having an interior for storage of the liquid; and a dispensing means in fluid connection with said interior of said liquid container, said dispensing means having an open position and a closed position a first urging means for urging said dispensing means from said open position to said closed position a second urging means for urging said dispensing means from said closed position to said open position, wherein said dispensing means is pivotally attached to said liquid container and wherein said first urging means pivots said dispensing means from said open position to said closed position and said second urging means pivots said dispensing means from said closed position to said open position, and wherein said dispensing means comprises a dispensing cap having a fluid passage therein and wherein said first urging means is a first surface on said dispensing cap which, when pressed, pivots said dispensing means from said open position to said closed position and said second urging means is a second surface on said dispensing cap which, when pressed, pivots said dispensing cap from said closed position to said open position.

6. The dispensing bottle of claim 5 wherein when said dispensing bottle is stored said dispensing bottle rests on a support surface of said dispensing bottle and wherein said first urging means is a first end of said support surface and said second urging means is a second end of said support surface, whereby a user may press said first end of said support surface against an object to move said dispensing means towards said open position, and whereby a user may press said second end of said support surface against an object to move said dispensing means towards said closed position.

7. The dispensing bottle of claim 6 wherein said support surface is tiltable and wherein when said dispensing cap is in said closed position said support surface is generally horizontal.

8. The dispensing bottle of claim 5 wherein said first urging means is a first end of a bottom surface of said dispensing bottle, and said second urging means is a second end of said bottom surface, whereby a user may press said first end of said bottom surface against an object to move said dispensing means towards said open position, and whereby a user may press said second end of said bottom surface against an object to move said dispensing means towards said closed position.

9. The dispensing bottle of claim 5 wherein said first urging means and said second urging means are substantially unencumbered by surrounding structure, whereby a user may press said first urging means against a substantially flat surface to move said dispensing cap from said closed position to said open position, and whereby the user may press said second urging means against a substantially flat surface to move said dispensing cap from said open position to said closed position.

10. The dispensing bottle of claim 9 wherein said dispensing means further comprises a detent for holding said dispensing means in said open position.

11. The dispensing bottle of claim 9 wherein said dispensing means further comprises a biasing means for urging said dispensing means from said open position to said closed position.

12. A dispensing cap for dispensing a substance from a container, the dispensing cap comprising:

a dispensing means having an open position and a closed position and a first urging means for urging said dispensing means from said open position to said closed position a second urging means for urging said dispensing means from said closed position to said open position, wherein said means is pivotally attached to the container and wherein said first urging means pivots said dispensing means from said open position to said closed position and said second urging means pivots said dispensing means from said closed position to said open position, and wherein said dispensing cap provides a fluid passage therethrough and wherein said first urging means is a first surface on said dispensing cap which, when pressed, pivots said dispensing means from said open position to said closed position and said second urging means is a second surface on said dispensing cap which, when pressed, pivots said dispensing cap from said closed position to said open position.

13. The dispensing cap of claim 12 comprising and attachment means for attaching said dispensing means to the container.

14. The dispensing cap of claim 12 wherein said dispensing cap provides a support surface on which said dispensing cap and the container may be supported when in a storage position.

15. The dispensing cap of claim 12 wherein a majority of said dispensing cap is tiltable between said closed position and said open position.

16. The dispensing cap of claim 12 wherein when said dispensing bottle is stored said dispensing bottle rests on a support surface of said dispensing bottle and wherein said first urging means is a first end of said support surface and said second urging means is a second end of said support surface, whereby a user may press said first end of said support surface against an object to move said dispensing means towards said open position, and whereby a user may press said second end of said support surface against an object to move said dispensing means towards said closed position.

17. The dispensing cap of claim 16 wherein said support surface is tiltable and wherein when said dispensing cap is in said closed position said support surface is generally horizontal.

18. The dispensing cap of claim 17 wherein said first urging means is a first end of a bottom surface of said dispensing bottle, and said second urging means is a second end of said bottom surface, whereby a user may press said first end of said bottom surface against an object to move said dispensing means towards said open position, and whereby a user may press said second end of said bottom surface against an object to move said dispensing means towards said closed position.

19. The dispensing bottle of claim 12 wherein said first urging means and said second urging means are substantially unencumbered by surrounding structure, whereby a user may press said first urging means against a substantially flat surface to move said dispensing cap from said closed position to said open position, and whereby the user may press said second urging means against a substantially flat surface to move said dispensing cap from said open position to said closed position.

* * * * *